US009592420B2

(12) United States Patent
Noyes et al.

(10) Patent No.: US 9,592,420 B2
(45) Date of Patent: Mar. 14, 2017

(54) RESISTANCE BAND BENCH AND RESISTANCE BAND ORIENTING AND SECURING DEVICE

(71) Applicants: Dave Noyes, North Las Vegas, NV (US); Jeremy Blunk, Alexandria, VA (US)

(72) Inventors: Dave Noyes, North Las Vegas, NV (US); Jeremy Blunk, Alexandria, VA (US)

( * ) Notice: Subject to any disclaimer, the term of this patent is extended or adjusted under 35 U.S.C. 154(b) by 20 days.

(21) Appl. No.: 14/862,943

(22) Filed: Sep. 23, 2015

(65) Prior Publication Data

US 2016/0089558 A1 Mar. 31, 2016

Related U.S. Application Data

(60) Provisional application No. 62/055,331, filed on Sep. 25, 2014.

(51) Int. Cl.

| | |
|---|---|
| ***A63B 21/00*** | (2006.01) |
| ***A63B 21/04*** | (2006.01) |
| ***A63B 21/055*** | (2006.01) |
| *A63B 71/00* | (2006.01) |

(52) U.S. Cl.

CPC ..... *A63B 21/4043* (2015.10); *A63B 21/0414* (2013.01); *A63B 21/0552* (2013.01); *A63B 21/4029* (2015.10); *A63B 21/00069* (2013.01); *A63B 21/0557* (2013.01); *A63B 21/4019* (2015.10); *A63B 71/0009* (2013.01); *A63B 2208/0233* (2013.01); *A63B 2208/0252* (2013.01); *A63B 2210/50* (2013.01); *A63B 2225/09* (2013.01)

(58) Field of Classification Search

USPC ..... 482/1–148

See application file for complete search history.

(56) References Cited

U.S. PATENT DOCUMENTS

| | | | | |
|---|---|---|---|---|
| 5,549,529 | A * | 8/1996 | Rasmussen | A63B 21/00181 482/96 |
| 6,110,081 | A | 8/2000 | Barrett | |
| 6,817,968 | B2 * | 11/2004 | Galbraith | A63B 21/0552 482/121 |
| 6,981,932 | B1 * | 1/2006 | Huang | A63B 21/00072 482/121 |
| 7,591,763 | B1 | 9/2009 | Fucci | |
| 7,892,155 | B2 * | 2/2011 | Pearson | A63B 21/026 482/121 |
| 7,998,042 | B2 * | 8/2011 | Bowser | A63B 21/04 482/121 |

(Continued)

*Primary Examiner* — Stephen Crow

(74) *Attorney, Agent, or Firm* — Weide & Miller, Ltd.

(57) ABSTRACT

An exercise bench is provided that facilitates exercises performed with a resistance band. The exercise bench includes a supporting frame and a back support member and a seat support member attached to the frame. The back support member is selectively movable to different angles relative to the seat support member. At least one resistance band securing device attaches to one or both of the supporting frame and the back support member. The resistance band securing device selectively securing the resistance band to the exercise bench. At least one resistance band orienting member adjusts an angle of the resistance band relative to the resistance band securing device.

19 Claims, 4 Drawing Sheets

(56) References Cited

U.S. PATENT DOCUMENTS

| | | | | |
|---|---|---|---|---|
| 9,211,433 | B2 * | 12/2015 | Hall | A63B 69/10 |
| 2006/0183606 | A1 * | 8/2006 | Parmater | A63B 22/0076 482/72 |
| 2013/0059703 | A1 | 3/2013 | Calantoni | |

* cited by examiner

RESISTANCE BAND BENCH AND RESISTANCE BAND ORIENTING AND SECURING DEVICE

CROSS REFERENCE TO RELATED APPLICATION

This application claims the benefit of and priority to U.S. Provisional Application No. 62/055,331 which was filed Sep. 25, 2014, the contents of which are hereby incorporated by reference.

BACKGROUND

1. Field

The disclosed embodiments relate to exercise equipment. More specifically, the disclosed embodiments relate to resistance band exercise equipment.

2. Related Art

The use of fitness bands (resistance bands) is well known. Fitness bands are used by personal trainers and others in the fitness industry as an effective way to work various muscle groups of the human body. Additionally, such fitness bands are often used as a part of physical therapy. For example, fitness bands may be used in therapy to help restore a patient's range of motion after a surgery or injury. Fitness bands may also be used for therapy to help amputees build strength and learn to function with a prosthetic. Such fitness bands may provide resistance equivalent to lifting hundreds of pounds to only fractions of a pound.

An exercise bench for use in lifting free weights is also known. Such benches may be configured in a variety of positions to orient a person lifting weights to work a particular muscle group. For example, exercise benches may be adjustable so that a person may be supported in a sitting or lying-down position.

However, there exists a need to effectively incorporate exercises that may be done with fitness bands with an exercise bench so as to allow the advantages of fitness bands for patients while doing exercises in positions typically supported by an exercise bench.

SUMMARY

The disclosed embodiments have been developed in light of this and aspects of the invention include a bench incorporating a plurality of resistance band orienting and securing devices. In some embodiments, the exercise bench may comprise a supporting frame and a back support member and a seat support member that are attached to the frame. The back support member may be selectively movable to different angles relative to the seat support member.

At least one resistance band securing device may be attached to one or both of the supporting frame and the back support member. The at least one resistance band securing device may secure the resistance band to the exercise bench. At least one resistance band orienting member may adjust an angle of the resistance band relative to the resistance band securing device.

In further embodiments, the exercise bench further comprises at least one rail, the resistance band securing device being mounted to the rail and being moveable along the rail to be selectively secured in multiple locations along the rail. In some instances, a first rail is disposed on a back side of the back support member, a second rail is disposed on the supporting frame, and a resistance band securing device is disposed on each of the first and second rails.

The resistance band orienting member may be a T-bar. The T-bar may include a lateral member and a cross bar, the cross bar including flanges on the ends thereof. In some embodiments, two T-bars may be attached to the frame such that the T-bars may rotate about the frame. An additional T-bar may be attached to the frame at a forward end thereof, and the T-bar may be selectively extendable from the front of the frame.

In some embodiments, the resistance band securing device may include a mounting member and a cover rotatably attached at one end thereof to the mounting member. The cover may thus be selectively positioned relative to the mounting member in one of an open and a closed position. The resistance band securing device may further comprise a securing member that selectively fastens the cover to the mounting member in the closed position.

In resistance band securing devices according to some embodiments, the mounting member may comprise a friction inducing surface, and the cover may also comprise a corresponding friction inducing surface. A resistance band may be fixed between the friction inducing surface and the corresponding friction inducing surface when the resistance band securing device is in the closed position.

According to some embodiments, the securing member may comprise a screw with a corresponding wing nut. The mounting member may have a front notch, and the cover may also have a corresponding front notch. The screw is configured to seat within the front notch and the corresponding front notch when the resistance band securing device is in the closed position.

In other exemplary embodiments, an exercise system is provided. The exercise system may include at least one resistance band and an exercise bench. The bench may comprise a supporting frame and a back support member and a seat support member that are attached to the supporting frame. The back support member may be selectively movable to different angles relative to the seat support member.

The system may further include at least one resistance band securing device attaching to at least one of the supporting frame and the back support member. The at least one resistance band securing device may selectively secure the resistance band to the exercise bench. At least one resistance band orienting member may be provided to adjust an angle of the resistance band relative to the resistance band securing device.

In some embodiments, the system may include a resistance band gripping device configured to grip an end of the resistance band so as to help an amputee perform exercises or physical therapy. The resistance band gripping device comprises a cover that is configured to be placed over an amputee's stump of a limb, a belt attached to the cover and configured to tighten the cover about the amputee's limb, and a resistance band catch disposed at a distal end of the cover configured to catch or grip an end of the resistance band. The resistance band catch may comprise at least one of a hook, clamp, loop, or carabiner.

In some embodiments, the resistance band securing device includes a mounting member and a cover rotatably attached at one end thereof to the mounting member. The cover may thus be selectively positioned relative to the mounting member in one of an open and a closed position. The resistance band is configured to be held between the mounting member and the cover when the device is in the closed position.

The resistance band securing device may also have a securing member that selectively fastens the cover to the mounting member in the closed position. To facilitate exercises where an amputee may have limbs of different lengths, the fitness band may be positioned off-center within the resistance band securing device.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF EMBODIMENTS

Figure 1:
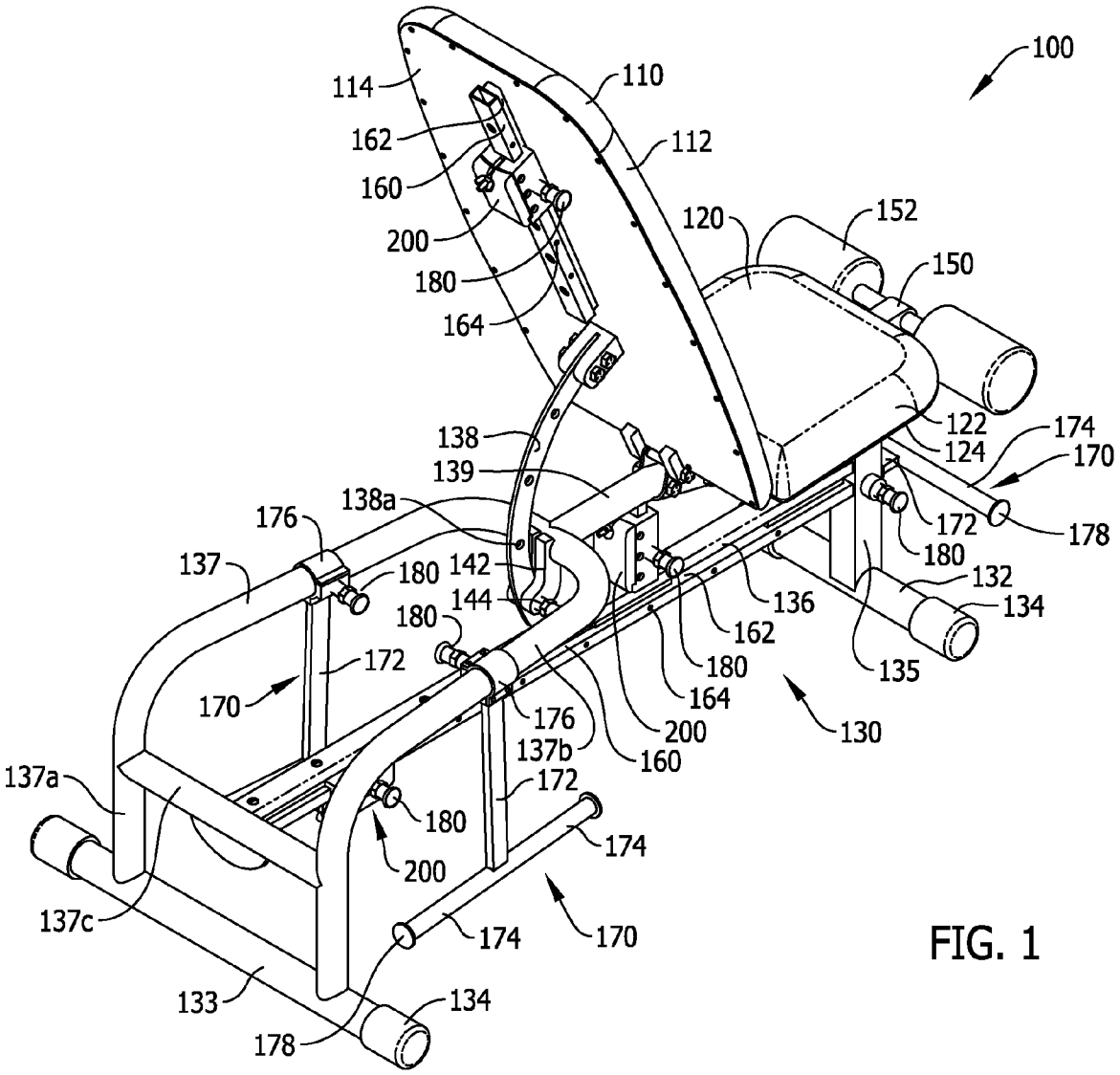
FIG. 1 is an exercise bench configured to perform exercises with one or more resistance bands, according to one exemplary embodiment.

A resistance band bench and resistance band orienting and securing devices according to the disclosed embodiments will be described below. As shown in FIG. 1, a resistance band bench is similar to a standard exercise weight bench. In FIG. 1, a resistance band bench 100 the resistance band bench includes a user support surface including a back support 110 and a body seat support 120 which may be cushioned and on which a user lies or sits during use. The bench 100 further comprises a frame 130 to support and adjust the position of the support surfaces 110, 120. In this manner, the bench 100 may be collapsible, portable, and easily stored even in small areas. The resistance band bench 100 is constructed of lightweight, durable materials such as weight bearing brushed aluminum, steel or steel alloys, composite type plastics, or similar materials.

The user support surface of the resistance band bench includes an adjustable back support 110. The back support 110 is configured to adjust to one of a plurality of angles relative to a seat support 120. This allows a user to lie or sit at a number of positions so as to be able to perform different exercises. The back support 110 may comprise a cushion 112 to provide comfort to the user during exercises. The cushion 112 may be mounted to a rigid supporting plate 114 which provides the supporting structure of the back support 110.

Similarly, the user support surface includes an adjustable seat support 120. The adjustable seat support 120 may adjust to one or more of a plurality of angles allowing a user to perform different exercises on the bench 100. In other embodiments, the seat support 120 may remain in a single position, while only the back support 110 is adjustable. The seat support 120 may comprise a cushion 122 to provide comfort to a user while doing exercises. The cushion 122 may be mounted to a rigid supporting plate 124 which provides the supporting structure of the seat support 120. In the present embodiment, the back support 110 and the seat support 120 are configured to be positioned at least at four different angles relative to each other.

The back support 110 and the seat support 120 are disposed on a bench frame 130. The bench frame 130 provides the overall structure and support for the bench 100. The bench frame comprises a lower front horizontal support bar 132 and a lower rear horizontal support bar 133. To provide traction and to protect a floor surface the lower horizontal support bars 132, 133 may be fitted with bumper covers 134. The bumper covers 134 are placed on ends of the support bars 132, 133 to prevent the horizontal support bars 132, 133 from coming into contact with and damaging a floor surface. The bumper covers 134 may be made of material to increase friction between the bench 100 and the supporting surface, such as a natural or a synthetic rubber, soft PVC, or the like.

A vertical support bar 135 extends upwards from the front lower horizontal support bar 132. A rear support frame 137 extends upward from the rear horizontal support bar 134. A lower lateral support member 136 extends from the front to the rear of bench 100 and connects to the vertical support bar 135 on a front end and the rear support frame 137 on a rear end.

The rear support frame 137 includes vertical members 137*a* that extend upwards from the rear lower horizontal support bar 134. The vertical members 137*a* curve into a lateral portion 137*b* of the frame 137. The lateral portion 137*b* of the frame 137 may support the back support 110 when the back support 110 is in a lying down position. The rear support frame 137 also includes a horizontal stabilizer 137*c*. In this embodiment, the lower lateral support member 136 connects to the horizontal stabilizer 137*c*.

A seat support member 139 extends from the front of the rear support frame 137 to the vertical support bar 135. The seat support 120 is mounted to the seat support member 139 and the vertical support bar 135. A back support adjustment member 138 is provided to releasably connect with the rear support frame 137 to adjust the angle of the back support 110 as shown. The back support adjustment member 138 may include a number of apertures 138*a*. An anchoring mechanism 142 may be mounted to the lateral portion 137*b* of the rear support frame 137. The anchoring mechanism may include a spring loaded pin 144 that anchors the back support adjustment member 138 in one of a number of positions by extending through one of the apertures 138*a*. Other similar mechanisms may be used such as a set screw, a through-pin, or the like.

The bench 100 may further comprise a leg support 150. The leg support 150 may have two cylindrical cushions 152 on which a user may position his or her legs to perform exercises with his or her legs.

The bench 100 further comprises rails 160 for facilitating the anchoring of exercise bands, which will be described in more detail below. In this embodiment, a first rail 160 is disposed on the back of the seat support 110 and is attached to the rigid supporting plate 114. A second rail 160 is disposed along the lower lateral support member 136.

The rails 160 include a track 162 for guiding a resistance band orienting and securing device 200 (described below) along the rail 160. The rail 160 may further comprise a number of rail apertures 164. By way of a spring loaded pin 180, the apertures 164 facilitate selective locking of the securing device 200 in a number of positions.

The bench 100 may further comprise a number of T-bars 170. The T-bars may comprise a lateral member 172 and cross bar 174 disposed at the end of the lateral member 172.

The T-bars 170 are adjustable relative to the bench 100 to facilitate different exercises with a fitness band. The T-bars 170 may be referred to as a resistance band orienting device to adjust the angle or orientation of the fitness bands with respect to the user to facilitate different exercises, as described in more detail below. Any number of suitable shapes other than a T-bar may be utilized, such as a U-shaped bar, a hoop, or the like.

In this embodiment, two T-bars are connected to the lateral portion 137*b* of the rear support frame 137. These T-bars are connected to the lateral portion 137*b* by way of a hollow cylindrical members 176. The hollow cylindrical members 176 allow the T-bars to swivel around and move laterally along the lateral portion 137*b*. The cylindrical members 176 are selectively set into place by way of a spring loaded pin 180 that interacts with corresponding apertures (not shown) or by way of a set screw that may tighten the T-bar 170 into position.

A third T-bar 170 is disposed at a front end of the bench 100. This T-bar 170 is configured to extend in and out of a front end of the lower lateral support member 136. The T-bar 170 may be secured by a spring loaded pin 180 that extends through the vertical support bar 135.

As stated above, the bench 100 includes one or more resistance band orienting and securing devices ("RBOSD") 200. In this embodiment, there are three RBOSDs 200. A first RBOSD 200 is configured to attach to and run along the rail 160 connected to the rigid plate 114 of the back support 110. A second RBOSD 200 is configured to run along the rail 160 disposed along the lower lateral support member 136. A third RBOSD 200 is configured to be mounted to the seat support member 139.

The RBOSDs 200 are configured to orient and secure any number of standard fitness bands to various locations of the frame 130. Such fitness bands may include high resistance bands, tubular resistance bands, physical therapy resistance bands, flat type resistance bands, ultra-thin resistance bands, and the like. The resistance provided by such resistance bands may range from a fraction of a pound to hundreds of pounds.

Figure 2A:
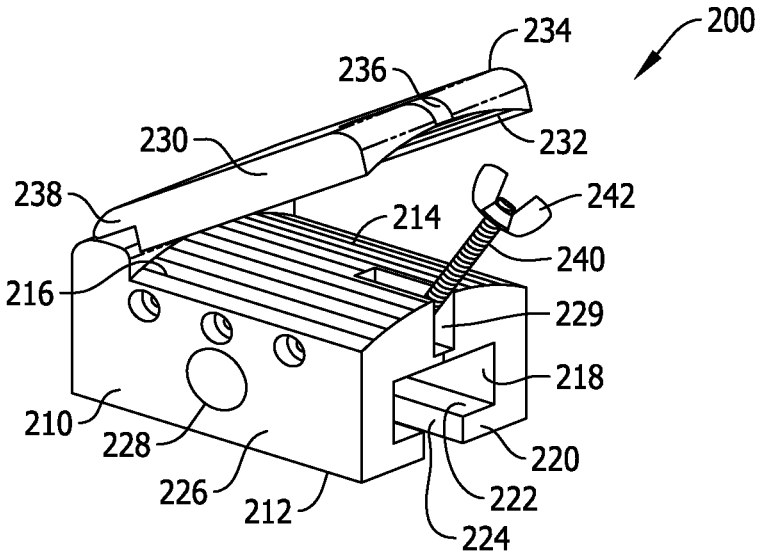
FIG. 2A is a clamping device for clamping a resistance band onto an exercise bench.
Figure 2B:
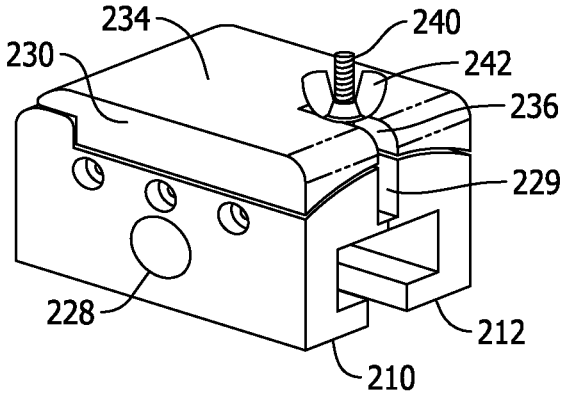
FIG. 2B is the clamping device of 2A shown in a closed position, according to one exemplary embodiment.

Detailed views of the RBOSDs 200 are shown in FIGS. 2A and 2B in an open and a closed position. As shown in FIG. 2A, the RBOSD 200 comprises a mounting member 210. The mounting member 210 has a mounting side 212 and a band securing side 214 opposite the mounting side 212. The mounting side 212 of the member 210 is mounted to a rail 160 of the bench 100.

The band securing side 214 is configured to receive and secure a fitness exercise band. The band securing side 214 includes a first securing surface 216. The first securing surface 216 may be formed with a rough, jagged, or other high friction surface so as to grip onto a fitness band during use, as described in more detail below.

The member 210 further comprises a slot 218 that extends laterally through the member 210. The slot 218 is includes a flange 220 that extends from sidewalls of the slot 218. The flange 220 forms a locking surface 222 that locks the mounting member 210 on the track 162 of the rail 160 and a guiding surface 224 that follows the track 162 such that the mounting member 210 may slide along the track 162.

The mounting member 210 further comprises sidewalls 226 adjacent to the mounting side 212 and the band securing side 214. The sidewalls 226 may comprise a locking aperture 228. The locking aperture 228 may be configured with internal threads to mount the spring loaded pin 180 to selectively secure the mounting member 210 of the RBOSD 200 to the rail 160 at various desired positions.

The RBOSD 200 further comprises a securing cover 230. The securing cover 230 is attached to the mounting member 210 at an end 238 and is configured to swivel about the end 238, such as with a hinge. A lower securing surface 232 is provided with a friction inducing surface similar to surface 216. When the securing cover 230 is brought into the closed position as shown in FIG. 2B, the surfaces 216 and 232 together hold a fitness band in place.

The RBOSD 200 further includes a securing member to hold the securing cover 230 against the securing side 214 of the mounting member 210. In this embodiment, the mounting member 210 includes a front notch 229 on a front surface of the securing side 214. A screw 2410 is attached within the notch 229 and may swivel about the attachment point within the notch 229. The cover 230 also comprises a front notch 236. When the cover is brought to the closed position shown in FIG. 2B, the screw 240 may swivel to be within the front notch 236 of the cover 230. A nut 242, such as a locking wing nut is threaded over the screw 240 and tightened down against a top surface 243 of the cover 230.

Of course, the screw 240 and nut 242 may be loosened and swiveled away from the notch 236 to allow the cover to again return to the open position as shown in FIG. 2A. In this manner, the fitness bands may be exchanged or repositioned.

As explained above, one of the RBOSDs 200 may be mounted on the frame 130 at seat support member 139, as shown in FIG. 1. This RBOSD 220 may be configured to secure a fitness band to allow a user to exercise muscle groups in the legs. The position of the RBOSD may be varied based on adjustments made to the frame 130. Different leg exercises may be performed by utilizing the front T-bar 170.

Another RBOSDs 200 may be located on the rigid plate 114 of the back support 110. This RBOSD 200 may be selectively positioned along the rail 160 connected to the plate 114 using the spring loaded pin 180. A variety of chest and arm exercises done at a plurality of different angles may be completed.

A third RBOSD 200 is located along the lower lateral member 136 and may be selectively positioned along the rail 160 connected to the lower lateral member 136. This RBOSD 200 facilitates exercises when the back support 110 is in a horizontal or slightly angled position relative to the horizontal. The RBOSD 200 clamps the fitness band which may then be wrapped around the rear T-bars 170 in various positions to achieve many different types of motions.

Figure 3:
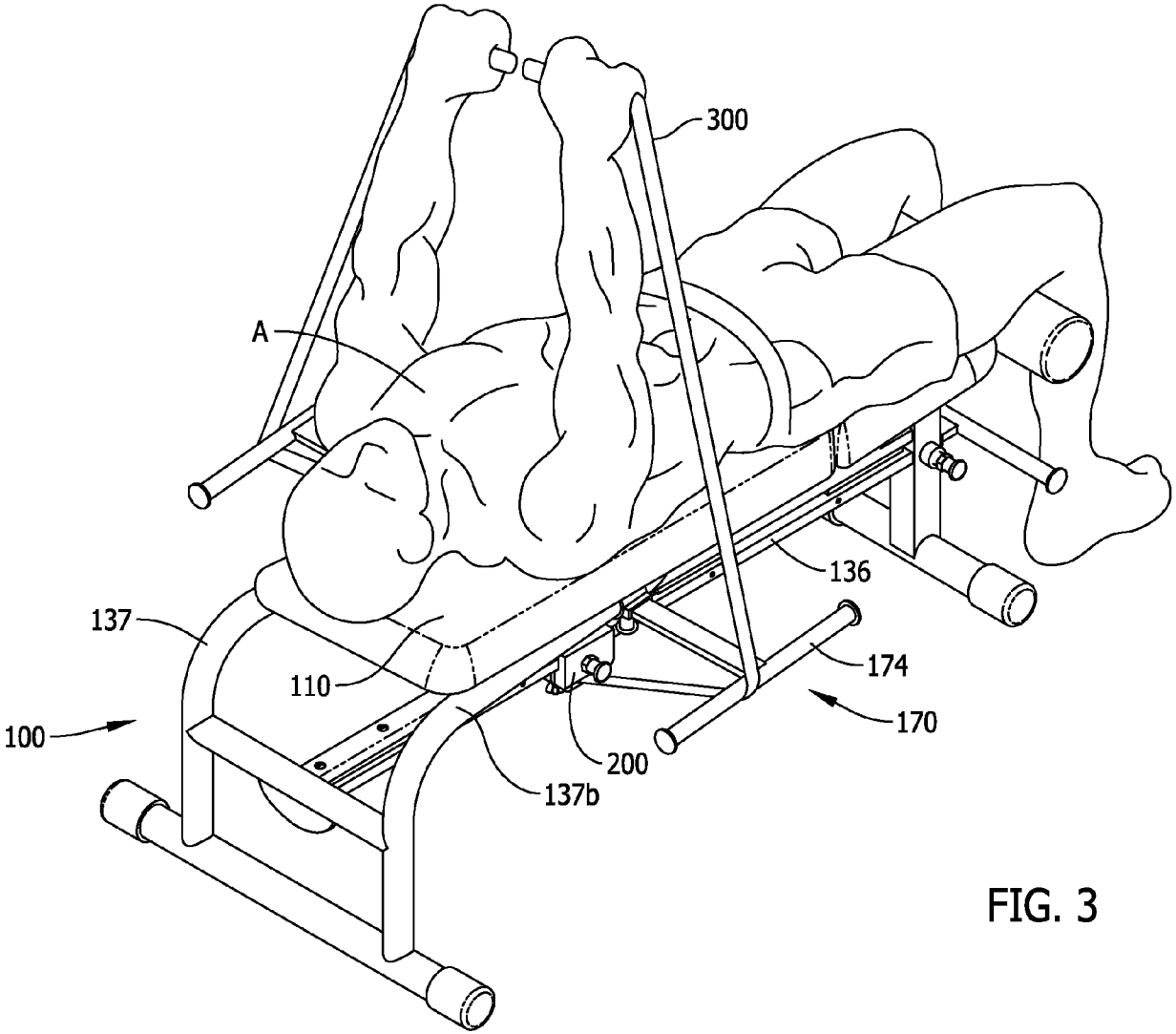
FIG. 3 shows an exercise bench in use with a resistance band, according to one exemplary embodiment.

An example of this is shown in FIG. 3. Here, a user A adjusts the T-bars 170 so that they extend perpendicular from the lateral portion 137*b* of the rear support frame 137. The RBOSD 200 running along the lower lateral member 136 is also positioned in the desired location. A fitness band 300 is secured within the RBOSD 200 and is pulled around the outside of the cross bar 174. The user A then performs the exercise supported by the bench 100 as shown.

The disclosed bench 100 and RBOSDs 200 provide a number of advantages. Because the RBOSDs allow for flexible positioning and can accommodate all sizes of fitness bands, beginners to advanced trainers and all categories in between can use the bench 100. The bench 100 is thus easy and effective for any fitness level and allows the user to increase or decrease the intensity of the workout by adjusting the angles of resistance and the size or type of bands. Advanced athletes can utilize the broad range of resistance bands available to increase the tension for more explosive workouts. The beginners can decrease the possibility of injury using resistance bands compared to free weight systems.

Further, because there are no need for free weights, pulley systems, and the like, the resistance band bench may be portable and may also be collapsible. This provides the user with flexibility in the storage and location of the bench when in and out of use. Further, because the RBOSDs may be positioned at a variety of locations and allows the use of standard fitness bands with the bench in a plurality of positions, the bench and RBOSDs offer a very flexible system for toning a user's body. This is because it offers an essentially unlimited range of motions allowing a user to target more muscles and allowing control over how powerful a workout should be for each individual.

The system further allows for typical free weight exercises to be conveniently completed with fitness bands or tubes. Resistance bands or tubing offer tension during both phases of an exercise, so that the user is constantly working against resistance. The offers benefits over free weights in which momentum may decrease the quality of the workout or lead to accidental injury of the user. Additionally, by using the system, compound movements on the bench are facilitated to work more than one muscle group simultaneously.

The system not only provides advantages for exercise, but may also be especially useful for personal therapy. Because the RBOSDs allow for flexible positioning of the fitness bands, the correct level of resistance may be offered to a patient undergoing therapy. Further, practically all ranges of motion are available for therapy using this system. Thus, the system may allow therapy that not only targets particular areas of the body, but that can mimic movement that occurs naturally.

Additionally, because the bands may be secured at any desired position, the system may be particularly adapted to patients in therapy who are amputees. For example, a band may be secured in the RBOSD 200 "off-center" so as to fit a returning soldier who has lost a part of arm enabling proper therapy and range of motion for the solder. Further, the bench 100 may be fitted with any number of RBOSDs 200 at any desired location along the frame to accommodate all types of individuals with various kinds of physical limitations.

Figure 4:
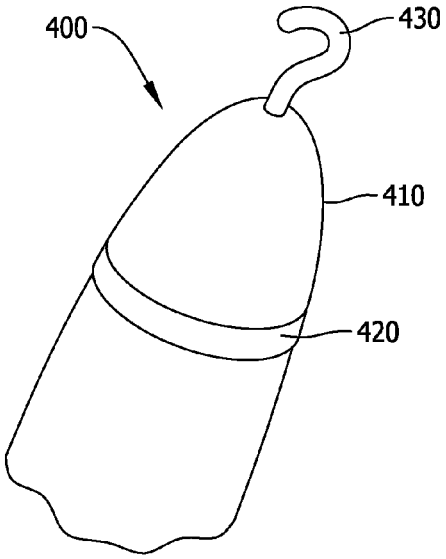
FIG. 4 shows an example of a prosthetic resistance band gripper, according to one exemplary embodiment.

The system may further comprise band accessories that facilitate exercises for amputees. For example, the accessories may include a band gripping device 400 as shown in FIG. 4. The band gripping device 400 may attach to a stump of a limb to enable an amputee to hold on to an end of the resistance band. For example, the device 400 may have a cover 410 that is fastened around an amputee's limb by way of an elastic or belt 420 to secure the cover 410. The device 400 may have a hook 430 or other device to grab or hold onto an end of a fitness band. For example, instead of the hook 430, a loop, clamp, a carabiner type device, or any other type of device may be used. In this manner, the amputee can confidently grip the band and perform the exercise without the band slipping. The band gripping devices 400 may be constructed of any suitable material including nylon or other synthetic materials.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An exercise bench facilitating exercises performed with a resistance band, the exercise bench comprising: a supporting frame; a back support member and a seat support member being attached to the frame; the back support member being selectively movable to different angles relative to the seat support member;

at least one resistance band;

at least one resistance band securing device slidably attached to at least one of the supporting frame and the back support member, the at least one resistance band securing device securing the resistance band to the exercise bench;

and at least one resistance band orienting member adjustably attached to the exercise bench and having a laterally extending member that adjusts an angle of the resistance band relative to the resistance band securing device.

2. The exercise bench according to claim 1, further comprising at least one rail, the resistance band securing device being mounted to the rail and being moveable along the rail to be selectively secured in multiple locations along the rail.

3. The exercise bench according to claim 2, wherein a first rail is disposed on a back side of the back support member, a second rail is disposed on the supporting frame, and a resistance band securing device is disposed on each of the first and second rails.

4. The exercise bench according to claim 1, wherein the resistance band orienting member is a T-bar including a lateral member and a cross bar, the cross bar including flanges on the ends thereof.

5. The exercise bench according to claim 4, wherein two T-bars are attached to the frame such that the T-bars may rotate about the frame.

6. The exercise bench according to claim 4, wherein a T-bar is attached to the frame at a forward end thereof, the T-bar being selectively extendable from the frame.

7. The exercise bench according to claim 1, wherein the resistance band securing device includes a mounting member and a cover rotatably attached at one end thereof to the mounting member, the cover being selectively positioned relative to the mounting member in one of an open and a closed position.

8. The exercise bench according to claim 7, wherein the resistance band securing device further comprises a securing member that selectively fastens the cover to the mounting member in the closed position.

9. The exercise bench according to claim 7, wherein the mounting member comprises a friction inducing surface, the cover comprises a corresponding friction inducing surface, and a resistance band is fixed between the friction inducing surface and the corresponding friction inducing surface when the resistance band securing device is in the closed position.

10. The exercise bench according to claim 8, wherein the securing member comprises a screw with a corresponding wing nut, the mounting member comprises a front notch, the cover comprises a corresponding front notch, and the screw is configured to seat within the front notch and the corresponding front notch when the resistance band securing device is in the closed position.

11. An exercise system comprising: at least one resistance band;

an exercise bench comprising: a supporting frame;

a back support member and a seat support member being attached to the supporting frame; the back support member being selectively movable to different angles relative to the seat support member;

at least one resistance band securing device attaching to at least one of the supporting frame and the back support member, the at least one resistance band securing device selectively securing the resistance band to the exercise bench; at least one rail, the resistance band securing device being mounted to the rail and being moveable along the rail to be selectively secured in multiple locations along the rail; and at least one resistance band orienting member that adjusts an angle of the resistance band relative to the resistance band securing device.

12. The exercise system according to claim 11, further comprising a resistance band gripping device configured to grip an end of the resistance band, the resistance band gripping device comprising:

a cover that is configured to be placed over an amputee's stump of a limb, a belt attached to the cover and configured to tighten the cover about the amputee's limb, and a resistance band catch disposed at a distal end of the cover configured to catch or grip an end of the resistance band.

13. The exercise system according to claim 12, wherein the resistance band catch comprises at least one of a hook, clamp, loop, or carabiner.

14. The exercise system according to claim 12, wherein the resistance band securing device includes a mounting member and a cover rotatably attached at one end thereof to the mounting member, the cover being selectively positioned relative to the mounting member in one of an open and a closed position, and the resistance band being configured to be held between the mounting member and the cover in the closed position.

15. The exercise system according to claim 14, wherein the resistance band securing device further comprises a securing member that selectively fastens the cover to the mounting member in the closed position.

16. The exercise system according to claim 15, wherein the resistance band is positioned off-center within the resistance band securing device.

17. The exercise system according to claim 11, wherein a first rail is disposed on a back side of the back support member, a second rail is disposed on the supporting frame, and a resistance band securing device is disposed on each of the first and second rails.

18. An exercise system comprising: at least one resistance band;

an exercise bench comprising: a supporting frame;

a back support member and a seat support member being attached to the supporting frame; the back support member being selectively movable to different angles relative to the seat support member;

at least one resistance band securing device attaching to at least one of the supporting frame and the back support member, the at least one resistance band securing device selectively securing the resistance band to the exercise bench; and at least one resistance band orienting member that adjusts an angle of the resistance band relative to the resistance band securing device, wherein the resistance band orienting member is a T-bar including a lateral member and a cross bar, the cross bar including flanges on the ends thereof.

19. The exercise system according to claim 18, wherein two T-bars are attached to the frame such that the T-bars may rotate about the frame.

* * * * *